US006094003A

United States Patent [19]

Kim et al.

[11] Patent Number: 6,094,003

[45] Date of Patent: Jul. 25, 2000

[54] ANTI-DOMING COMPOSITION FOR A SHADOW-MASK AND PROCESSES FOR PREPARING THE SAME

[75] Inventors: Jae Myung Kim, Suwon-shi; Hwan Chul Rho, Kyungki-do; Dong Hee Han, Suwon-shi; Sung-Hwan Moon, Seoul, all of Rep. of Korea

[73] Assignee: Samsung Display Devices Co., Ltd., Kyungki-do, Rep. of Korea

[21] Appl. No.: 08/955,164

[22] Filed: Oct. 21, 1997

[30] Foreign Application Priority Data

Oct. 31, 1996 [KR] Rep. of Korea ..... 96/51355
Oct. 31, 1996 [KR] Rep. of Korea ..... 96/51356
Oct. 31, 1996 [KR] Rep. of Korea ..... 96/51357

[51] Int. Cl.[7] ..... H01J 29/07

[52] U.S. Cl. ..... 313/402; 445/47

[58] Field of Search ..... 313/402; 106/626, 106/467, 618; 445/47

[56] References Cited

U.S. PATENT DOCUMENTS 4,572,843 2/1986 Saito et al. ..... 427/53.1
4,983,136 1/1991 Okuda ..... 445/47
5,118,982 6/1992 Inoue et al. ..... 310/366
5,281,470 1/1994 Kobayashi et al. ..... 428/241

FOREIGN PATENT DOCUMENTS 283527 12/1987 Japan ..... 445/47

*Primary Examiner*—Kenneth J. Ramsey
*Attorney, Agent, or Firm*—Christie, Parker & Hale, LLP

[57] ABSTRACT

An anti-doming composition including a mixture of electron reflecting material such as bismuth oxide, and a zeolite, and a shadow-mask coated with the composition restrict temperature increase by preventing heat transfer, an anti-doming composition including lead and a ZnO, $B_2O_3$, $Bi_2O_3$ or a mixture thereof, and a shadow-mask coated with the composition protect mechanical expansion of a shadow-mask, and an anti-doming composition including ferroelectrics such as PZT, PT, PZ or PLZT, and a shadow-mask coated with the composition restrict temperature increase by changing the energy of electron beams into non-thermal energy. The shadow-mask of the present invention reduces about 30 to 50% of the anti-doming ratio and has a low production cost and easiness during processes.

4 Claims, No Drawings

ANTI-DOMING COMPOSITION FOR A SHADOW-MASK AND PROCESSES FOR PREPARING THE SAME

BACKGROUND OF THE INVENTION

1) Field of the Invention

The present invention relates to an anti-doming composition for a shadow-mask particularly to 1) an anti-doming composition including a mixture of electron reflecting material such as bismuth oxide, and a zeolite to restrict temperature increase by coating the composition on the shadow-mask for a CRT (cathode-ray-tube), 2) an anti-doming composition including lead (Pb) and at least on of ZnO, $B_2O_3$ and $Bi_2O_3$ to protect mechanical expansion of a shadow-mask and to restrict temperature increase by coating the composition on the shadow-mask for a CRT 3) an anti-doming composition including ferroelectrics such as PZT ($PbZrTiO_3$), PT ($PbTiO_3$), PZ ($PbZrO_3$) or PLZT [$(PbLa)(ZrTi)O_3$] to restrict temperature increase by coating the composition on the shadow-mask for a CRT to change the energy of electron beams into non-thermal energy, and a process for preparing the same.

2) Description of the Related Art

In a conventional shadow-mask-type CRT, graphic images are reproduced by red, green, and blue electron beams emitted from means for producing them. The electron beams pass through a hole of a shadow-mask, converge into a point, and collide with red, green, and blue phosphors formed on a phosphor screen of an inner surface of a panel.

The shadow-mask used in the color CRT has a role of selecting an electron beams for a particular color among the electron beams emitted from an electron gun. The shadow-mask is generally produced with an AK(aluminum killed) steel which has a hundred thousand and tens of thousands hole formed by photolithography.

A general process for preparing the shadow-mask is more particularly described hereafter.

To allow a flatness and setting property to a mask panel, an AK steel is subjected to a roller leveling treatment causing a plastic deformation. Thereafter, the process for preparing holes in the mask panel is performed by photolithography. The photolithography process is performed with the sequence of coating a photoresist, exposing, developoing and etching the panel. According to the etching process, the panel has a number of holes passing electron beams through. The panel having holes is heat treated in a high temperature and hydrogen gas to give a ductility (annealing process) and then a forming process is performed to change the panel into a certain form by a press. After the forming process, the panel is subjected to a degreasing process to remove impurity attached on the surface of the panel. Thereafter, a blacking process is performed to improve anti-doming property of the shadow-mask.

About 20% of electron beams emitted from an electron gun and arrived in shadow-mask pass through the shadow-mask and cause to a luminescence of a phosphor screen. And, about 80% of the remaining electron beams are absorbed in the shadow-mask and cause to thermal expansion of the shadow-mask. In this circumstance, a temperature of the shadow-mask increases to about 80 to 90° C. As mentioned above, we call the thermal expansion of a shadow-mask as a doming phenomena. The doming phenomena results movement of holes in the shadow-mask, which induce change of luminescence positions, further more causes luminescence of different colors. Therefore, the doming phenomena decreases a color purity of CRTs. According to the requirement of preventing the doming phenomena, various kinds of anti-doming methods have developed.

U.S. Pat. Nos. 4,665,338 and 4,528,246 disclosure processes for preparing CRTs using a shadow-mask which is produced with an Invar steel to prevent decrease of color purity according to the doming phenomena. The Invar steel shows a preferable anti-doming property because it has 1/10 coefficient of expansion of an AK steel, $11.7\times10^{-6}$/K. Therefore, the Invar steel is usually used as a material of a shadow-mask for above 15 inch CRT. However, the Invar steel has problems of high cost and difficulty during processes.

Korean patent application No. 86-1589 disclosures and electron reflecting layer coated on the one side of an electron gun with heavy metals such as lead (Pb), bismuth (Bi) and tungsten (W) by aqueous emulsion method to reduce the heating caused by the electron beams. However, the metal layer cannot be easily coated, and anti-doming ratio is only about 30%, and the disclosed process has a problem of adjusting to a practical mass production. Additionally, the tungsten layer is usually oxidized at above 300° C. Therefore, the layer has a problem of vigorous oxidation at the temperature of about 450° C. reached in the process of baking and sealing.

SUMMARY OF THE INVENTION

To resolve the above problems, the present invention provides an anti-doming composition for a shadow-mask which has en anti-doming ratio of about 30 to 50% by restricting temperature increase with preventing expansion of the shadow-mask mechanically or changing the energy of electron beam into non-thermal energy, and a process for preparing the same. Further more, The shadow-mask of the present invention has a low production cost and easiness during processes.

Additional objects, advantages and novel features of the invention will be set forth in part in the description which follows, and in part will become apparent to those skilled in the art upon examination of the following or may be learned by practice of the invention. The object and advantages of the invention may be realized and attained by means of the instrumentalities and combinations particular pointed out in the appended claims.

In the following detailed description, only the preferred embodiment of the invention has been shown and described, simply by way of illusion of the best mode contemplated by the inventor(s) of carrying out the invention. As will be realized, the invention is capable of modification in various obvious respects, all without departing from the invention. Accordingly, the description is to be regarded as illustrative in nature, and not as restrictive.

DETAILED DESCRIPTION OF THE INVENTION

To achieve the above objects, the present invention provides an anti-doming composition for a shadow-mask comprising a vehicle and a zeolite, and also provides an anti-doming composition for a shadow-mask comprising a vehicle, an electron reflecting material selected from-the group consisting of bismuth oxide, lead and tungsten oxide, and a zeolite. And the present invention provides a shadow-mask comprising a steel layer having a plurality of holes for passing electron beams therethrough and a coating layer formed on the steel layer by using the anti-doming composition. It is preferable that an amount of said a zeolite is 10 to 90 weight % to the total amount of the composition, and the coating layer is prepared by a silk screen printing method and has a thickness of 3 to 30 $\mu$m.

The present invention provides a shadow-mask comprising a steel layer having a plurality of holes for passing electron beams therethrough, a first coating layer formed on the steel layer by using an anti-doming composition including a zeolite and a second coating layer formed on the first layer by using an anti-doming composition including an electron reflecting material selected from the group consisting of bismuth oxide, lead and tungsten oxide. It is preferable that the first and second coating layers are prepared by a silk screen printing method and have a thickness of 3 to 30 $\mu$m.

The present invention provides a process for preparing an anti-doming composition for a shadow-mask comprising the steps of mixing a vehicle and a zeolite, and also provides a process for preparing an anti-doming composition for a shadow-mask comprising the steps of mixing a vehicle, an electron reflecting material selected from the group consisting of bismuth oxide, lead and tungsten oxide, and a zeolite. In a process for preparing a shadow-mask comprising the steps of preparing a steel layer having a plurality of holes for passing electron beams therethrough and coating an-anti-doming composition to produce a coating layer on the steel layer, the improvement of the present invention is that the anti-doming composition includes an electron reflecting material selected from the group consisting of bismuth oxide, lead and tungsten oxide, and/or a zeolite. In a process for preparing a shadow-mask comprising the steps of preparing a steel layer having a plurality of holes for passing electron beams therethrough and coating an anti-doming composition to produce a coating layer on the steel layer, the improvement of the present invention is that forming a first coating layer prepared from a zeolite on the steel layer and forming a second coating layer prepared from an electron reflecting material selected from the group consisting of bismuth oxide, lead and tungsten oxide on the first coating layer. It is preferable that an amount of said a zeolite is 10 to 90 weight % to the total amount of the composition and the respective coating layer is prepared by a silk screen printing method and has a thickness of 3 to 30 $\mu$m.

The present invention provides an anti-doming composition for a shadow-mask comprising a vehicle, lead and at least one compound selected from the group consisting of ZnO, $B_2O_3$ and $Bi_2O_3$. It is preferable that an amount of said compound selected from the group consisting of ZnO, $B_2O_3$ and $Bi_2O_3$ is 5 to 50 weight % to the total amount of the composition. The present invention also provides a shadow-mask comprising a steel layer having a plurality of holes for passing electron beams therethrough and a coating layer using the above anti-doming composition. It is preferable that the coating layer is prepared by a silk screen printing method and has a thickness of 3 to 30 $\mu$m.

The present invention provides a process for preparing an anti-doming composition for a shadow-mask comprising the steps of mixing a vehicle, lead and at least one compound selected from the group consisting of ZnO, $B_2O_3$ and $Bi_2O_3$. It is preferable that an amount of said compound selected from the group consisting of ZnO, $B_2O_3$ and $Bi_2O_3$ is 5 to 50 weight % to the total amount of the composition. In a process for preparing a shadow-mask comprising the is steps of preparing a steel layer having a plurality of holes for passing electron beams therethrough and coating an anti-doming composition to produce a coating layer on the steel layer, the improvement of the present invention is that the anti-doming composition includes at least one compound selected from the group consisting of ZnO, $B_2O_3$ and $Bi_2O_3$. It is preferable that the coating layer is prepared by a silk screen printing method and has a thickness of 3 to 30 $\mu$m.

The present invention provides an anti-doming composition for a shadow-mask comprising a vehicle and at least one compound selected from the group consisting of PZT ($PbZrTiO_3$), PT ($PbTiO_3$), PZ ($PbZrO_3$) and PLZT [$(PbLa)(ZrTi)O_3$]. It is preferable that an amount of said compound selected from the group consisting of PZT, PT, PZ and PLZT is 30 weight % or more to the total amount of the composition. The present invention also provides a shadow-mask comprising a steel layer having a plurality of holes for passing electron beams therethrough and a coating layer using the above anti-doming composition. It is preferable that the coating layer is prepared by a silk screen printing method and has a thickness of 3 to 30 $\mu$m.

The present invention provides a process for preparing an anti-doming composition for a shadow-mask comprising the steps of mixing a vehicle and at least one compound selected from the group consisting of PZT, PT, PZ and PLZT. It is preferable that an amount of said compound selected from the group consisting of PZT, PT, PZ and PLZT is 30 weight % or more to the total amount of the composition. In a process for preparing a shadow-mask comprising the steps of preparing a steel layer having a plurality of holes for passing electron beams therethrough and coating an anti-doming composition to produce a coating layer on the steel layer, the improvement of the present invention is that the anti-doming composition includes at least one compound selected from the group consisting of PZT, PT, PZ and PLZT. It is preferable that the coating layer is prepared by a silk screen printing method and has a thickness of 3 to 30 $\mu$m.

DETAILED DESCRIPTION OF THE PREFERRED EMBODIMENTS

[Preparing an anti-doming composition using an electron reflecting material and a zeolite]

An electron reflecting material such as bismuth oxide, lead or tungsten oxide is mixed with a zeolite to produce a mixture. An epoxy based vehicle is added to the mixture to produce a paste type anti-doming composition for a shadow-mask. To prevent breakaway of particles after blacking and baking processes, appropriate amount of a low melting point frit is added to the composition. A zeolite which has a chemical formula of $Na_{12}[(AlO_2)_{12}(SiO_2)_{12}]\cdot XH_2O$ is a widely used clay mineral. The zeolite has micro pores so that is used as an absorbent, enzyme carrier, insulating material etc. In the present invention, the zeolite is used as an insulating material to prevent transfer of heat caused by electrons collided to a shadow-mask. The bismuth oxide has a role of restricting temperature increase by reflecting many of electron beams emitted from an electron gun before colliding the shadow-mask because it has a high electron reflecting coefficient. The above coating composition is coated on the shadow-mask passed thorough an annealing process by a silk screen printing method. By adjusting a blacking process, the shadow-mask having a coating layer to prevent a doming phenomena has more improved anti-doming property.

[Preparing an anti-doming composition using lead, ZnO, $B_2O_3$ and $Bi_2O_3$]

ZnO, $B_2O_3$ and $Bi_2O_3$ are mixed with lead to produce a mixture. An epoxy based vehicle is added to the mixture to produce a paste type anti-doming composition for a shadow-mask. The lead has a role of restricting temperature increase by reflecting many of electron beams emitted from an electron gun before colliding the shadow-mask because it has a high electron reflecting coefficient. And, ZnO, $B_2O_3$ and $Bi_2O_3$ have a role of a thermal expansion of the shadow-mask because they have a low coefficient of expansion. The above coating composition is coated on the shadow-mask passed thorough an annealing process by a silk screen printing method. By adjusting a blacking process, the shadow-mask having a coating layer to prevent a doming phenomena has more improved anti-doming property. According to the above process, the lead is melted and wrapped ZnO, $B_2O_3$ and $Bi_2O_3$ particles so that the breakaway of the particles is prevented in the following processes.

[Preparing an anti-doming composition by using PZT, PT, PZ and PLZT]

An epoxy based vehicle is added to PZT, PT, PZ, PLZT or a mixture thereof to produce a paste type anti-doming composition for a shadow-mask. To prevent breakaway of particles after blacking and baking processes, appropriate amount of a low melting point frit is added to the composition. PZT, PT, PZ, PLZT or a mixture thereof which has piezoelectric and pyroelectric effects has a role of restricting temperature increase of the shadow-mask by changing the energy of electron beams into non-thermal energy. The above coating composition is coated on the shadow-mask passed thorough an annealing process by a silk screen printing method. By adjusting a blacking process, the shadow-mask having a coating layer to prevent a doming phenomena has more improved anti-doming property. According to the above process, the frit is melted and wrapped PZT, PT, PZ, PLZT particles so that the breakaway of the particles is prevented in the following processes.

Preferable examples and reference example are described below. These examples are exemplary only, and the present invention is not restricted to the scope of the example.

EXAMPLE 1

16 g of butyl carbitol and 4 g of epoxy resin was mixed with to prepare a vehicle. 20 g of the zeolite was added to 40 g of bismuth oxide particles, and then 20 g of firt was added to produce a mixed particles. The mixed particles were added to the vehicle to produce an anti-doming composition for a shadow- mask of the present invention. The above coating composition was coated on the shadow-mask passed thorough an annealing process by a silk screen printing method in 20 $\mu$m thickness of a coating layer. By adjusting a blacking process with a temperature of 570° C., the shadow-mask having the coating layer to prevent a doming phenomena has more improved anti-doming property.

EXAMPLE 2

16 g of butyl carbitol and 4 g of epoxy resin was mixed with to prepare a vehicle. 10 g of the zeolite was added to 50 g of lead particles, and then 20 g of firt was added to produce a mixed particles. The mixed particles were added to the vehicle to produce an anti-doming composition for a shadow-mask of the present invention. The above coating composition was coated on the shadow-mask passed thorough an annealing process by a silk screen printing method in 20 $\mu$m thickness of a coating layer. By adjusting a blacking process with a temperature of 570° C., the shadow-mask having the coating layer to prevent a doming phenomena has more improved anti-doming property.

EXAMPLE 3

16 g of butyl carbitol and 4 g of epoxy resin was mixed with to prepare a vehicle. 10 g of the zeolite was added to 60 g of tungsten oxide particles, and then log of firt was added to produce a mixed particles. The mixed particles were added to the vehicle to produce an anti-doming composition for a shadow-mask of the present invention. The above coating composition was coated on the shadow-mask passed thorough an annealing process by a silk screen printing method in 15 $\mu$m thickness of a coating layer. By adjusting a blacking process with a temperature of 570° C., the shadow-mask having the coating layer to prevent a doming phenomena has more improved anti-doming property.

EXAMPLE 4

16 g of butyl carbitol and 4 g of epoxy resin was mixed with to prepare a vehicle. 40 g of frit was added to 40 g of zeolite to produce a mixed particles. 16 g of frit was added to 64 g of bismuth oxide particles to produce another mixed particles. The mixed particles were respectively added to the vehicle to produce an anti-doming compositions for a shadow-mask of the present invention. The coating composition having the zeolite was coated on the shadow-mask passed thorough an annealing process by a silk screen printing method in 10 $\mu$m thickness of a first coating layer. With the same method, the coating composition having bismuth oxide was coated on the first coating layer. By adjusting a blacking process with a temperature of 570° C., the shadow-mask having the two coating layers to prevent a doming phenomena has more improved anti-doming property.

EXAMPLE 5

16 g of butyl carbitol and 4 g of epoxy resin was mixed with to prepare a vehicle. 40 g of frit was added to 40 g of the zeolite to produce a mixed particles. 20 g of frit was added to 64 g of lead particles to produce another mixed particles. The mixed particles were respectively added to the vehicle to produce an anti-doming compositions for a shadow-mask of the present invention. The coating composition having the zeolite was coated on the shadow-mask passed thorough an annealing process by a silk screen printing method in 10 $\mu$m thickness of a first coating layer. With the same method, the coating composition having lead was coated on the first coating layer. By adjusting a blacking process with a temperature of 570° C., the shadow-mask having the two coating layers to prevent a doming phenomena has more improved anti-doming property.

EXAMPLE 6

16 g of butyl carbitol and 4 g of epoxy resin was mixed with to prepare a vehicle. 40 g of frit was added to 40 g of the zeolite to produce a mixed particles. 30 g of frit was added to 50 g of tungsten oxide particles to produce another mixed particles. The mixed particles were respectively added to the vehicle to produce an anti-doming compositions for a shadow-mask of the present invention. The coating composition having the zeolite was coated on the shadow-mask passed thorough an annealing process by a silk screen printing method in 10 $\mu$m thickness of a first coating layer. With the same method, the coating composition having tungsten oxide was coated on the first coating layer. By adjusting a blacking process with a temperature of 570° C., the shadow-mask having the two coating layers to prevent a doming phenomena has more improved anti-doming property.

EXAMPLE 7

16 g of butyl carbitol and 4 g of epoxy resin was mixed with to prepare a vehicle. 40 g of frit was added to 40 g of the zeolite to produce a mixed particles. The mixed particles were added to the vehicle to produce an anti-doming composition for a shadow-mask of the present invention. The above coating composition was coated on the shadow-mask passed thorough an annealing process by a silk screen printing method in 10 μm thickness of a coating layer. By adjusting a blacking process with a temperature of 570° C., the shadow-mask having the coating layer to prevent a doming phenomena has more improved anti-doming property.

EXAMPLE 8

16 g of butyl carbitol and 49 of epoxy resin was mixed with to prepare a vehicle. 40 g of ZnO was added to 40 g of lead particles to produce a mixed particles. The mixed particles were added to the vehicle to produce an anti-doming composition for a shadow-mask of the present invention. The above coating composition was coated on the shadow-mask passed thorough an annealing process by a silk screen printing method in 20 μm thickness of a coating layer. By adjusting a blacking process with a temperature of 570° C., the shadow-mask having the coating layer to prevent a doming phenomena has more improved anti-doming property.

EXAMPLE 9

16 g of butyl carbitol and 4 g of epoxy resin was mixed with to prepare a vehicle. 20 g of ZnO was added to 60 g of lead particles to produce a mixed particles. The mixed particles were added to the vehicle to produce an anti-doming composition for a shadow-mask of the present invention. The above to coating composition was coated on the shadow-mask passed thorough an annealing process by a silk screen printing method in 20 μm thickness of a coating layer. By adjusting a blacking process with a temperature of 570° C., the shadow-mask having the coating layer to prevent a doming phenomena has more improved anti-doming property.

EXAMPLE 10

16 g of butyl carbitol and 4 g of epoxy resin was mixed with to prepare a vehicle. 16 g of frit was added to 64 g of PZT particles to produce a mixed particles. The mixed particles were added to the vehicle to produce an anti-doming composition for a shadow-mask of the present invention. The above coating composition was coated on the shadow-mask passed thorough an annealing process by a silk screen printing method in 20 μm thickness of a coating layer. By adjusting a blacking process with a temperature of 570° C., the shadow-mask having the coating layer to prevent a doming phenomena has more improved anti-doming property.

EXAMPLE 11

16 g of butyl carbitol and 4 g of epoxy resin was mixed with to prepare a vehicle. 8 g of frit was added to 72 g of PZT particles to produce a mixed particles. The mixed particles were added to the vehicle to produce an anti-doming composition for a shadow-mask of the present invention. The above coating composition was coated on the shadow-mask passed thorough an annealing process by a silk screen printing method in 25 μm thickness of a coating layer. By adjusting a blacking process with a temperature of 570° C., the shadow-mask having the coating layer to prevent a doming phenomena has more improved anti-doming property.

REFERENCE EXAMPLE 1

A shadow-mask was prepared with the same method of Example 1 except not forming the coating layer.

A doming ratio is generally determined by measuring a maximum distance between an unheated beam position and the beam position when heated and shows a doming phenomena. Doming ratios of the 25 inch AK steel shadow-masks coated with the composition according to Examples and Reference Example are shown in following Table 1.

TABLE 1

| | Maximum Doming Ratio (μm) | Amount of Doming Reduction (%) |
|---|---|---|
| Example 1 | 40 | 33.3 |
| Example 2 | 42 | 30.0 |
| Example 3 | 35 | 41.7 |
| Example 4 | 35 | 41.7 |
| Example 5 | 38 | 36.7 |
| Example 6 | 30 | 50.0 |
| Example 7 | 40 | 33.3 |
| Example 8 | 35 | 41.7 |
| Example 9 | 40 | 33.3 |
| Example 10 | 38 | 36.7 |
| Example 11 | 36 | 40.0 |
| Reference Example 1 | 60 | — |

As the results of preparing the anti-doming compositions and shadow-masks coated with the compositions according to Examples and Reference Example, the shadow-masks of Examples 1 to 7 reduce the doming ratio to about 30 to 50% compared with the shadow-mask of the Reference Example because the shadow-masks of Examples 1 to 7 restrict the temperature increase by an electron reflecting effect caused by the electron reflecting materials and an insulating effect caused by the zeolite. Further more, the shadow-masks produced with the process of Examples 1 to 7 has a low production cost and easiness during processes. A 4A type zeolite was used in the Examples, however we could obtain the same results by using 3A, 5A and X type zeolites which have the same molecular structure with the 4A type zeolite but different at the size of micro pores.

The shadow-masks of Examples 8 and 9 reduce the doming ratio to about 30 to 40% or more compared with the shadow-mask of the Reference Example by restricting the temperature increase. And the shadow-masks produced with the process of Examples 8 and 9 also has a low production cost and easiness during processes.

The shadow-masks of Examples 10 and 11 reduce the doming ratio to about 30 to 40% compared with the shadow-mask of the Reference Example by restricting the temperature increase. And the shadow-masks produced with the process of Examples 10 and 11 also has a low production cost and easiness during processes.

In this disclosure, there is shown and described only the preferred embodiment of the invention, but, as aforementioned, it is to be understood that the invention is capable of use in various other combination and environments and is capable of changes or modification within the scope of the inventive concepts as expressed herein.

What is claimed is:

1. A shadow mask comprising:

a steel layer having a plurality of holes for passing electron beams therethrough; and a coating layer using an anti-doming composition comprising a vehicle selected from epoxy resins and butyl carbitol and at least one compound selected from the group consisting of PZT ($PbZrTiO_3$), PT ($PbTiO_3$), PZ ($PbZrO_3$) and PLZT [$(PbLa)(ZrTi)O_3$].

2. The shadow-mask as claimed in claim 1, wherein said coating layer is prepared by a silk screen printing method and has a thickness of 3 to 30 $\mu$m.

3. In a process for preparing a shadow-mask comprising the steps of preparing a steel layer having a plurality of holes for passing electron beams therethrough and coating an anti-doming composition to produce a coating layer on the steel layer, the improvement comprising:

said anti-doming composition includes at least one vehicle selected from the group consisting of epoxy resins and butyl carbitol and at least one compound selected from the group of PZT ($PbZrTiO_3$), PT ($PbTiO_3$), PZ ($PbZrO_3$), and PLZT [$(PbLa)(ZrTi)O_3$].

4. The process as claimed in claim 3, wherein said coating layer is prepared by a silk screen printing method and has a thickness of 3 to 30 $\mu$m.

* * * * *